US006125723A

United States Patent [19]

Huang

[11] Patent Number: 6,125,723

[45] Date of Patent: Oct. 3, 2000

[54] DRIVING DEVICE FOR TUBULAR MEMBER

[76] Inventor: Wu Sheng Huang, P.O. Box 63-99, Taichung, Taiwan, 406

[21] Appl. No.: 09/347,429

[22] Filed: Jul. 2, 1999

[51] Int. Cl.[7] ..... B25B 13/52

[52] U.S. Cl. ..... 81/64; 81/3.43

[58] Field of Search ..... 81/64, 3.43, 3.4

[56] References Cited

U.S. PATENT DOCUMENTS

| | | | |
|---|---|---|---|
| 409,148 | 8/1889 | Haller | 81/64 |
| 876,469 | 1/1908 | Martin et al. | 81/64 |
| 1,898,409 | 2/1933 | Underwood | 81/64 |
| 2,128,991 | 9/1938 | Eighmey | 81/64 |
| 2,132,207 | 10/1938 | Donovan | 81/64 |
| 2,181,012 | 11/1939 | Bunting | 81/64 |
| 4,082,016 | 4/1978 | Vonusa | 81/3.43 |
| 4,543,858 | 10/1985 | Luck | 81/64 |
| 4,987,804 | 1/1991 | Greenawalt | 81/64 |
| 5,522,284 | 6/1996 | Sade | 81/64 |

FOREIGN PATENT DOCUMENTS

| | | | |
|---|---|---|---|
| 2031314 | 4/1980 | United Kingdom | 81/64 |

*Primary Examiner*—David A. Scherbel
*Assistant Examiner*—Joni B. Danganan

[57] ABSTRACT

A driving device for driving a tubular member includes a belt slidably received in handle and has one end secured to the handle to form a loop for engaging onto the tubular member. A cam is pivotally and eccentrically secured to the handle and has one or more teeth biased to engage with the clamping belt and to secure the clamping belt to the handle. The handle further includes a pawl having one or more teeth for engaging with the clamping belt and for allowing the tubular member to be solidly driven or rotated by the driving device.

6 Claims, 4 Drawing Sheets

DRIVING DEVICE FOR TUBULAR MEMBER

BACKGROUND OF THE INVENTION

1. Field of the Invention

The present invention relates to a driving device, and more particularly to a driving device for driving tubular members.

2. Description of the Prior Art

Typical adjustable wrenches are provided for driving the tubular members. However, the tubular members will normally be deformed or damaged by the wrenches after driven by the wrenches.

The present invention has arisen to mitigate and/or obviated the afore-described disadvantages of the conventional tubular member driving devices.

SUMMARY OF THE INVENTION

The primary objective of the present invention is to provide a driving device for driving tubular members without damaging the tubular members.

In accordance with one aspect of the invention, there is provided a driving device for engaging with and for driving a tubular member, the driving device comprising a handle including a first end and a second end, and including a channel formed therein, a clamping belt slidably received in the channel of the handle and including a first end secured to the first end of the handle and including a loop formed close to the first end of the clamping belt and located close to the first end of the handle for engaging onto the tubular member, and the clamping belt including a second end, and means for unidirectionally clamping the clamping belt to the handle. The clamping belt is forced to engage with the tubular member when the second end of the clamping belt is moved relative to the unidirectionally clamping means and is pulled away from the handle.

The unidirectionally clamping means includes a cam pivotally secured to the first end of the handle, the cam includes at least one tooth engaged with the clamping belt, and means for biasing the tooth of the cam to engage with the clamping belt and to secure the clamping belt to the handle.

The cam is eccentrically and rotatably secured to the first end of the handle at a shaft. The cam includes a slot formed therein, the handle includes a peg extended therefrom and slidably received in the slot of the cam, the biasing means includes a spring received in the slot of the cam and engaged between the peg and the cam for biasing the tooth of the cam to engage with the clamping belt. The cam includes a knurled portion for facilitating a rotation of the cam and for disengaging the tooth of the cam from the clamping belt.

The first end of the handle includes a slit formed therein and includes a pin extended therefrom, the first end of the clamping belt is received in the slit of the handle and engaged around the pin. A securing device is further provided for securing the first end of the clamping belt to the first end of the handle. The first end of the handle further includes a pawl having at least one tooth formed thereon for engaging with the clamping belt.

Further objectives and advantages of the present invention will become apparent from a careful reading of a detailed description provided hereinbelow, with appropriate reference to accompanying drawings.

DETAILED DESCRIPTION OF THE PREFERRED EMBODIMENTS

Figure 1:
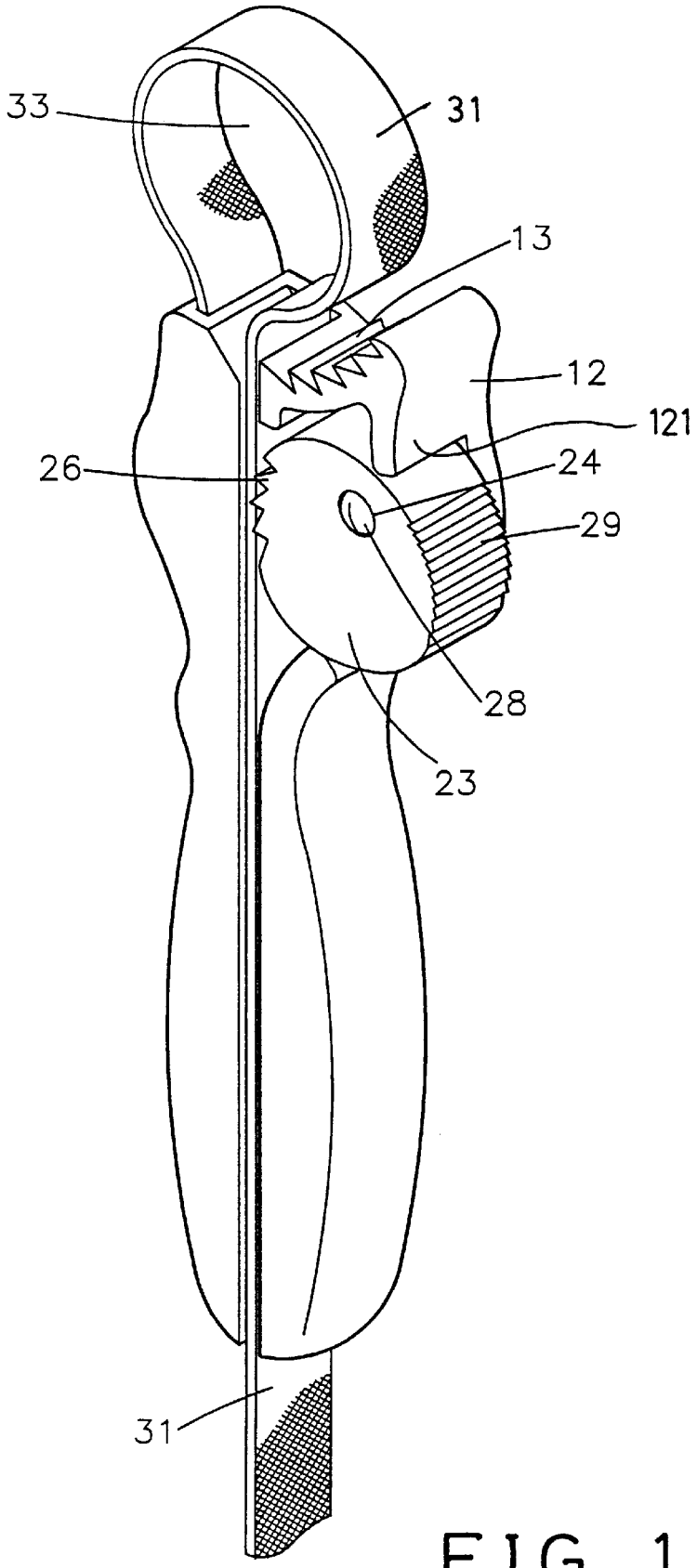
FIG. 1 is a perspective view of a driving device in accordance with the present invention.
Figure 2:
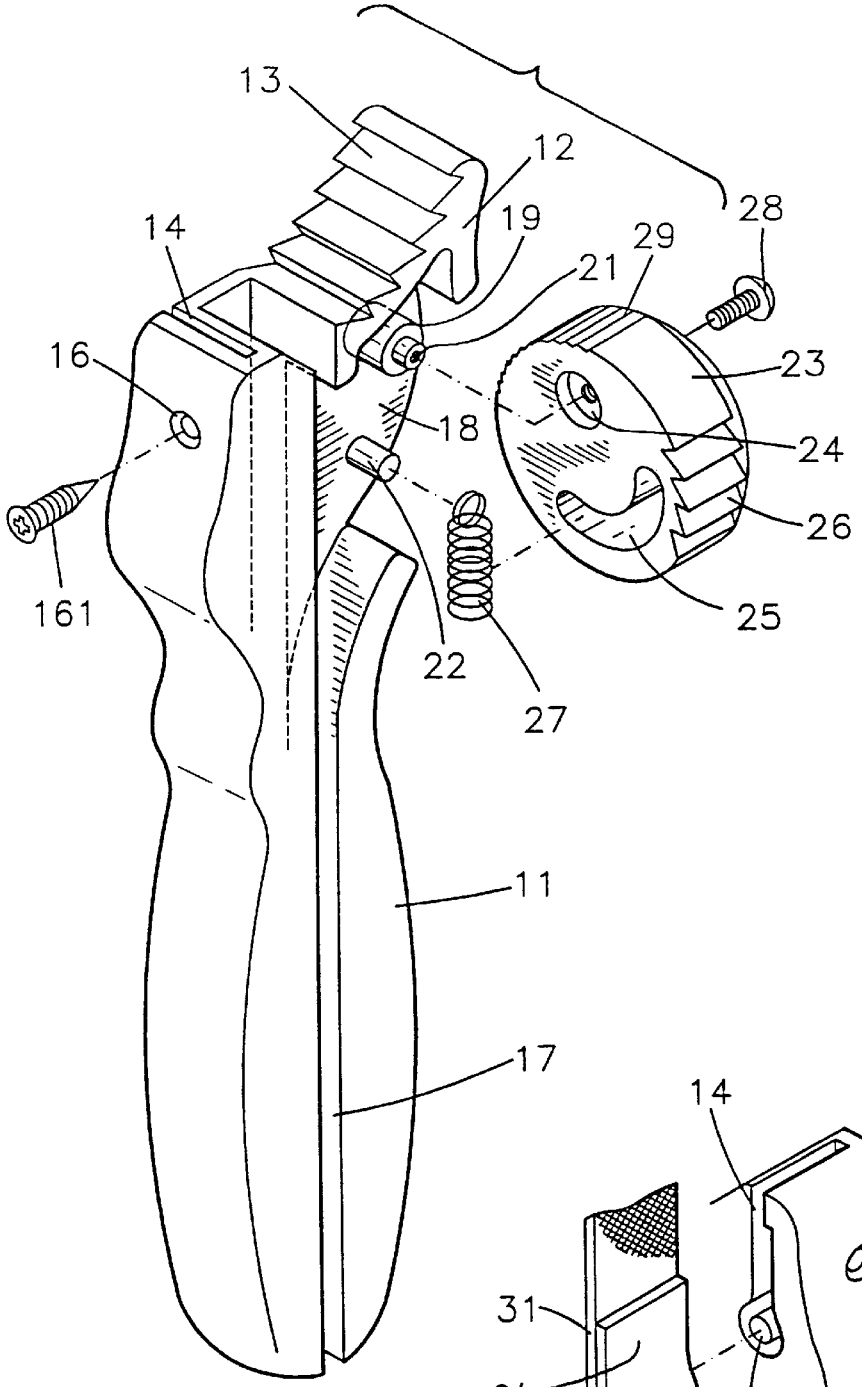
FIG. 2 is a partial exploded view of the driving device.
Figure 3:
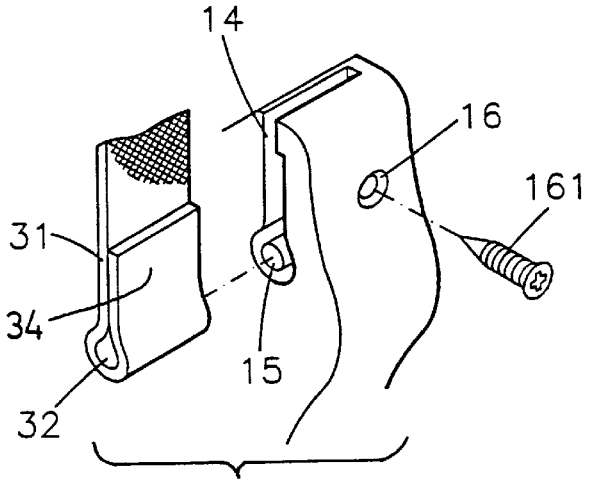
FIG. 3 is a partial exploded view illustrating the attachment of a clamping belt to the handle of the driving device.

Referring to the drawings, and initially to FIGS. 1–4, a driving device in accordance with the present invention is particularly designed for driving tubular members and comprises a handle 11 including a channel 17 longitudinally formed therein for slidably receiving a clamping belt 31. The handle 11 includes a slit 14 formed in one end and includes a pin 15 extended in the root portion of the slit 14 of the handle 11. The clamping belt 31 includes a loop 32 formed in the upper end thereof and defined by a bent segment 34 for engaging onto the pin 15. A fastener 161 may be engaged through a hole 16 of the handle 11 and may be engaged through the bent segment 34 and the clamping belt 31 for securing the end portion of the clamping belt 31 to the handle 11. The clamping belt 31 may be used to form an opening or a loop 33 for engaging with the tubular member 41 (FIG. 5) to be clamped and driven by the driving device.

The handle 11 includes a pawl 12 provided on the upper end thereof and having one or more ratchet teeth 13 formed thereon for engaging with the clamping belt 31 (FIG. 5) and for preventing the clamping belt 31 from becoming loose. The pawl 12 may include a hand grip 121 formed in the free end thereof for disengaging the teeth 13 thereof from the clamping belt 31 when the hand grip 121 is depressed away from the tubular member 41. The handle 11 includes a chamber 18 formed in the upper end thereof and communicating with the channel 17 of the handle 11, and includes a shaft 19 and a peg 22 extended inward of the chamber 18 and includes a screw hole 21 formed in the shaft 19.

A cam 23 includes an off-center aperture 24 formed therein for rotatably receiving the shaft 19 and for allowing the cam 23 to be eccentrically secured to the handle 11 at the shaft 19. A fastener 28 is threaded to the screw hole 21 of the shaft 19 for rotatably securing the cam 23 to the shaft 19. The cam 23 includes one or more ratchet teeth 26 formed in the peripheral portion thereof and located adjacent to the clamping belt 31 for engaging with the clamping belt 31. The cam 23 includes a curved slot 25 formed therein for slidably receiving the peg 22 and for limiting the rotational movement fo the cam 23 relative to the handle 11. The curved slot 25 includes a center of curvature located at the aperture 24 thereof or at the shaft 19. A spring 27 is received in the curved slot 25 of the cam 23 and has one end secured to the peg 22 for biasing the teeth 26 of the cam 23 to engage with the clamping belt 31 (FIGS. 1,4) and for preventing the clamping belt 31 from becoming loose. The cam 23 thus forms a unidirectionally clamping device for the clamping belt 31. The cam 23 includes an embossed or knurled outer peripheral portion 29 located opposite to the teeth 26 for allowing the user to rotate the cam 23 in order to disengage the teeth 26 from the clamping belt 31.

Figure 4:
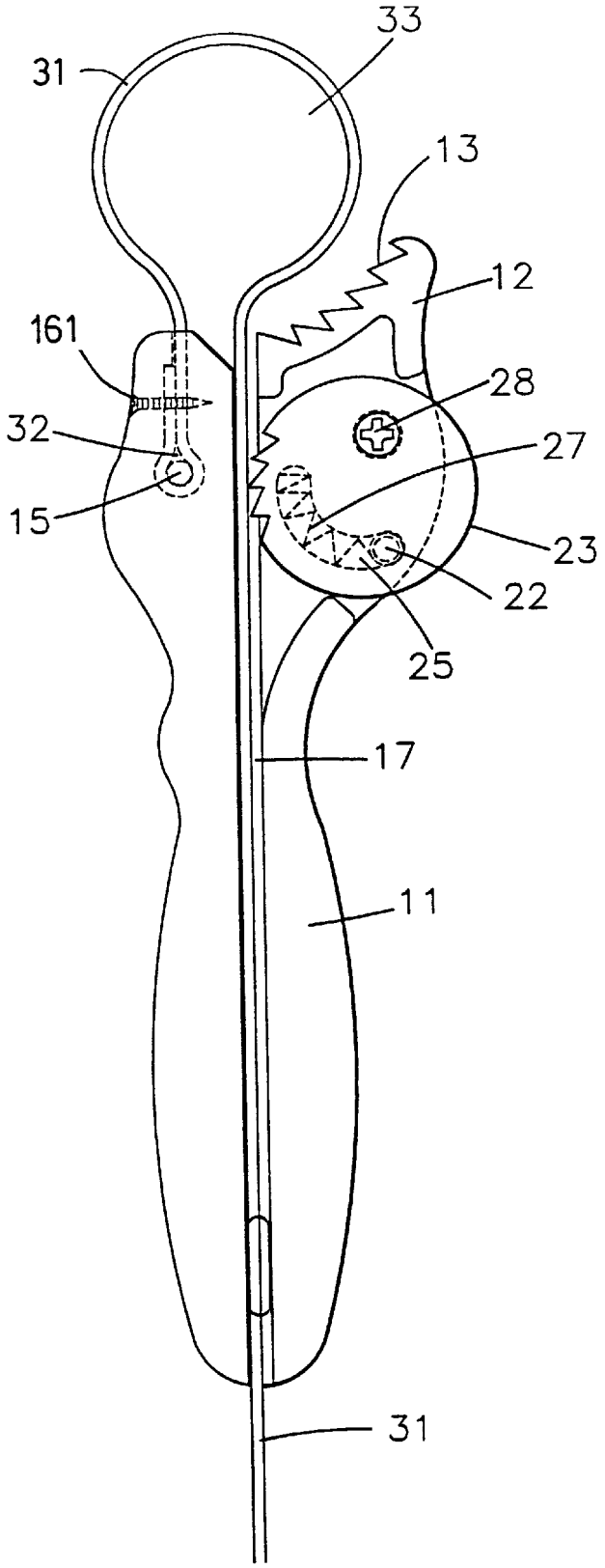
FIGS. 4 and 5 are plane views illustrating the operation of the driving device.
Figure 5:
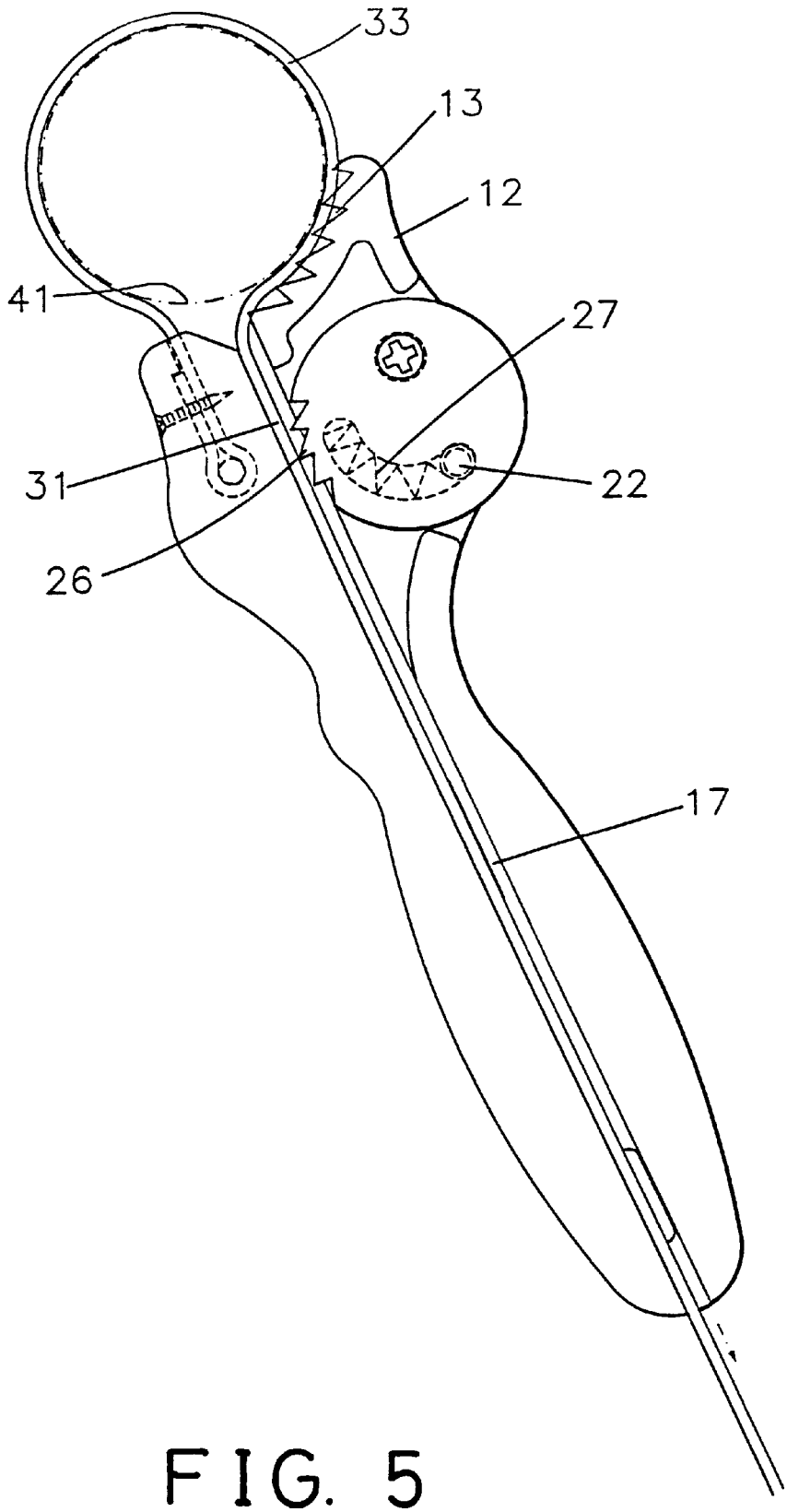

In operation, as shown in FIG. 4, the loop 33 of the clamping belt 31 may be enlarged by disengaging the teeth 26 of the cam 23 from the clamping belt 31, for allowing the loop 33 of the clamping belt 31 to be easily engaged onto the tubular member 41 (FIG. 5). The tubular member 41 may then be tightly secured in the loop 33 of the clamping belt 31 by pulling the lower end of the clamping belt 31 from the handle 11 and by pulling the clamping belt 31 relative to the teeth 26 of the cam 23. The tubular member 41 may be solidly secured to the handle 11 by the teeth 26 of the cam 23 even when the lower end of the clamping belt 31 is released, such that the tubular member 41 may be driven or rotated by the handle 11 at this moment. The tubular member 41 and the clamping belt 31 engaged on the tubular member 41 may then both be forced to engage with the teeth 13 of the pawl 12 when the lower end of the clamping belt 31 is further pulled away from the handle 11. Or, alternatively, the teeth 13 of the pawl 12 may be forced to engage with and to further secure the clamping belt 31 from becoming loose when the tubular member 41 is rotated by the handle 11 and is forced toward the pawl 12. The tubular member 1 may thus be further solidly clamped in place by the clamping belt 31 and may be driven or rotated by the handle 11. The loop 33 of the clamping belt 31 may apply a uniform clamping force against the tubular member 41 when the tubular member 41 is rotated by the handle 11 such that the tubular member 41 may be prevented from being damaged by the driving device fo the present invention. When it is required to release the tubular member 41, it is only required to rotate the cam 23 in order to disengage the teeth 26 of the cam 23 from the clamping belt 31. The clamping belt 31 may thus become loose before the teeth 26 of the cam 23 are biased to engage with the clamping belt 31 again.

Accordingly, the driving device in accordance with the present invention may be used for driving tubular members without damaging the tubular members.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A driving device for engaging with and for driving a tubular member, said driving device comprising:

a handle including a first end and a second end, and including a channel formed therein, said first end of said handle including a slit formed therein and including a pin extended therefrom, a clamping belt slidably received in said channel of said handle and including a first end secured to said first end of said handle and including a loop formed close to said first end of said clamping belt and located close to said first end of said handle for engaging onto the tubular member, and said clamping belt including a second end, and said first end of said clamping belt being received in said slit of said handle and engaged around said pin, means for securing said first end of said clamping belt to said first end of said handle, and means for unidirectionally clamping said clamping belt to said handle, said clamping belt being forced to engage with the tubular member when said second end of said clamping belt is moved relative to said unidirectionally clamping means and is pulled away from said handle.

2. The driving device according to claim 1, wherein said first end of said handle further includes a pawl having at least one tooth formed thereon for engaging with said clamping belt.

3. A driving device for engaging with and for driving a tubular member, said driving device comprising:

a handle including a first end and a second end, and including a channel formed therein, a clamping belt slidably received in said channel of said handle and including a first end secured to said first end of said handle and including a loop formed close to said first end of said clamping belt and located close to said first end of said handle for engaging onto the tubular member and said clamping belt including a second end, and means for unidirectionally clamping said clamping belt to said handle, said clamping belt being forced to engage with the tubular member when said second end of said clamping belt is moved relative to said unidirectionally clamping means and is pulled away from said handle, wherein said unidirectionally clamping means includes a cam pivotally secured to said first end of said handle, said cam includes at least one tooth engaged with said clamping belt, and means for biasing said at least one tooth of said cam to engage with said clamping belt and to secure said clamping belt to said handle.

4. The driving device according to claim 3, wherein said cam is eccentrically and rotatably secured to said first end of said handle at a shaft.

5. The driving device according to claim 3, wherein said cam includes a slot formed therein, said handle includes a peg extended therefrom and slidably received in said slot of said cam, said biasing means includes a spring received in said slot of said cam and engaged between said peg and said cam for biasing said at least one tooth of said cam to engage with said clamping belt.

6. The driving device according to claim 3, wherein said cam includes a knurled portion for facilitating a rotation of said cam and for disengaging said at least one tooth of said cam from said clamping belt.

* * * * *